US008344624B2

(12) United States Patent
Espiau et al.

(10) Patent No.: US 8,344,624 B2
(45) Date of Patent: Jan. 1, 2013

(54) PLASMA LAMP WITH DIELECTRIC WAVEGUIDE HAVING A DIELECTRIC CONSTANT OF LESS THAN TWO

(75) Inventors: Frederick M. Espiau, Topanga, CA (US); Mehran Matloubian, Encino, CA (US)

(73) Assignee: Topanga Technologies, Inc., Canoga Park, CA (US)

( * ) Notice: Subject to any disclaimer, the term of this patent is extended or adjusted under 35 U.S.C. 154(b) by 308 days.

(21) Appl. No.: 12/813,275

(22) Filed: Jun. 10, 2010

(65) Prior Publication Data

US 2011/0204781 A1 Aug. 25, 2011

Related U.S. Application Data

(60) Provisional application No. 61/186,354, filed on Jun. 11, 2009.

(51) Int. Cl.
*H05B 41/24* (2006.01)
*H01J 7/46* (2006.01)

(52) U.S. Cl. ..... 315/39; 315/248; 315/246; 315/32

(58) Field of Classification Search ..... 315/32, 315/34, 39, 40, 112, 113, 149, 248; 313/231.31, 313/231.61
See application file for complete search history.

(56) References Cited

U.S. PATENT DOCUMENTS

| | | | | |
|---|---|---|---|---|
| 7,362,056 | B2 | 4/2008 | Espiau et al. | |
| 8,022,607 | B2 * | 9/2011 | Chang et al. | 313/231.31 |
| 8,159,136 | B2 * | 4/2012 | DeVincentis et al. | 315/39 |
| 2008/0258627 | A1 * | 10/2008 | DeVincentis et al. | 315/39 |
| 2011/0204782 | A1 * | 8/2011 | Espiau et al. | 315/39 |
| 2011/0204783 | A1 * | 8/2011 | Matloubian et al. | 315/39 |

* cited by examiner

*Primary Examiner* — Vibol Tan
(74) *Attorney, Agent, or Firm* — Kilpatrick Townsend & Stockton LLP

(57) ABSTRACT

An electrodeless plasma lamp apparatus includes a waveguide body having at least a first material and a second material. At least one of the materials has a dielectric constant of less than two. In a specific embodiment, the apparatus also includes an RF power source coupled to the waveguide body to provide RF power to the waveguide body at least one frequency that resonates within the waveguide body. A bulb containing a fill which forms a plasma to cause emission of light when the RF power is provided to the waveguide body.

21 Claims, 5 Drawing Sheets

PLASMA LAMP WITH DIELECTRIC WAVEGUIDE HAVING A DIELECTRIC CONSTANT OF LESS THAN TWO

CROSS-REFERENCE TO RELATED APPLICATION

The present invention claims priority to U.S. Provisional Patent Application No. 61/186,354, filed Jun. 11, 2009, which is incorporated by reference herein for all purposes.

BACKGROUND OF THE INVENTION

This invention relates generally to lighting techniques, and provides a method and device using an electrodeless plasma lighting device having a dielectric waveguide of a dielectric constant of less than two. More particularly, the invention provides a method and apparatus having an electrodeless plasma lighting device using a ceramic resonator structure of a dielectric constant of less than two. The invention can be applied to a variety of applications including a warehouse lamp, stadium lamp, lamps in small and large buildings, vehicle headlamps, aircraft landing, bridges, warehouses, ultraviolet water treatment, agriculture, architectural lighting, stage lighting, medical illumination, microscopes, projectors and displays, any combination of these, and the like.

From the early days, human beings have used a variety of techniques for lighting. Early humans relied on fire to light caves during hours of darkness. Fire often consumed wood for fuel. Wood fuel was soon replaced by candles, which were derived from oils and fats. Candles were then replaced, at least in part by lamps. Certain lamps were fueled by oil or other sources of energy. Gas lamps were popular and still remain important for outdoor activities such as camping. In the late 1800, Thomas Edison, one of the greatest inventors of all time, conceived the incandescent lamp, which uses a tungsten filament within a bulb, coupled to a pair of electrodes. Many conventional buildings and homes still use the incandescent lamp, commonly called the Edison bulb. Although highly successful, the Edison bulb consumed much energy and was generally inefficient.

Fluorescent lighting replaced incandescent lamps for certain applications. Fluorescent lamps generally consist of a tube containing a gaseous material, which is coupled to a pair of electrodes. The electrodes are coupled to an electronic ballast, which helps ignite the discharge from the fluorescent lighting. Conventional building structures often use fluorescent lighting, rather than the incandescent counterpart. Fluorescent lighting is much more efficient than incandescent lighting, but often has a higher initial cost.

Shuji Nakamura pioneered the efficient blue light emitting diode, which is a solid state lamp. The blue light emitting diode forms a basis for the white solid state light, which is often a blue light emitting diode within a bulb coated with a yellow phosphor material. Blue light excites the phosphor material to emit white lighting. The blue light emitting diode has revolutionized the lighting industry to replace traditional lighting for homes, buildings, and other structures.

Another form of lighting is commonly called the electrodeless lamp, which can be used to discharge light for high intensity applications. Frederick M. Espiau was one of the pioneers that developed an improved electrodeless lamp. Such electrodeless lamp relied upon a solid ceramic resonator structure, which was coupled to a fill enclosed in a bulb. The bulb was coupled to the resonator structure via RF feeds, which transferred power to the fill to cause it to discharge high intensity lighting. The solid ceramic resonator structure has a limited dielectric constant. An example of such a solid ceramic waveguide is described in U.S. Pat. No. 7,362,056, which is hereby incorporated by reference herein. Although somewhat successful, the electrodeless lamp still had many limitations. As an example, electrodeless lamps have not been successfully deployed in high volume for general lighting applications. Additionally, the conventional lamp also uses a high frequency and has a relatively large size. Accordingly, the conventional lamp is often cumbersome and difficult to manufacture and use. These and other limitations of the conventional lamp are described throughout the present specification and more particularly below.

From the above, it is seen that improved techniques for lighting are highly desired.

BRIEF SUMMARY OF THE INVENTION

The present invention provides a method and device using a plasma lighting device having a dielectric waveguide with a dielectric constant of less than two. More particularly, the present invention provides a method and apparatus having an electrodeless plasma lighting device using a resonator structure having a dielectric constant of less than two. The invention can be applied to a variety of applications such as stadiums, security, parking lots, military and defense, streets, large and small buildings, vehicle headlamps, aircraft landing, bridges, warehouses, UV water treatment, agriculture, architectural lighting, stage lighting, medical illumination, microscopes, projectors and displays, and similar technologies.

In a specific embodiment, the present invention provides an electrodeless plasma lamp apparatus. The apparatus has a waveguide body having at least a first material and a second material. At least one of the materials has a dielectric constant of less than two. In a specific embodiment, the apparatus also has a power source coupled to the waveguide body to provide power to the waveguide body at least one frequency that resonates within the waveguide body. The apparatus has a bulb containing a fill to form a plasma to cause emission of light when the power is provided to the waveguide body. In a specific embodiment, the bulb has a single axis of rotational symmetry and is positioned proximate a central axis of the waveguide body, which has a length substantially parallel to the central axis and a width transverse to the length. In a preferred embodiment, either the first material or the second material is a fluid, which includes a gas, air, or other mixture, and the like. In alternative embodiments, the fluid can also be a liquid or a vapor or any combination of fluid entities.

Benefits are achieved over pre-existing techniques using the present invention. In a specific embodiment, the present invention provides a method and device having configurations of input, output, and feedback coupling elements that provide for electromagnetic coupling to the bulb whose power transfer and frequency resonance characteristics that are largely dependent upon a waveguide body having at least two materials. In a preferred embodiment, the present invention provides a method and configurations with an arrangement that provides for improved manufacturability as well as design flexibility. Other embodiments may include integrated assemblies of the output coupling element and bulb that function in a complementary manner with the present coupling element configurations and related methods for street lighting applications. In a preferred embodiment, the waveguide body comprises at least one dielectric material having a dielectric constant of two or less, which increases capacitance of the resonator and reduces overall size of the plasma lamp apparatus. For example, the dielectric material consists essentially of air (e.g., with a dielectric constant of about 1). In contrast, various types of conventional electrodeless lamps utilize high dielectric constant material in the waveguide to reduce the size of the waveguide. In certain embodiments of the present invention, dielectric materials such as air or fluid are used. For example, a portion or the entirety of a waveguide is filled with air. It is to be appreciated that air filled portion of the waveguide, compared to waveguide filled by high-dielectric constant material, has a reduced amount of RF loss (up to about 1 decibel) compared to conventional waveguide with high dielectric constant material, thereby improving performance. In addition, by filling a portion or an entirety of the waveguide with air instead of material with high dielectric constant, the manufacturing costs and weight of the waveguide are reduced. There are other benefits as well. In a specific embodiment, the present method and resulting structure are relatively simple and cost effective to manufacture for commercial applications. Depending upon the embodiment, one or more of these benefits may be achieved. These and other benefits may be described throughout the present specification and more particularly below.

The present invention achieves these benefits and others in the context of known process technology. However, a further understanding of the nature and advantages of the present invention may be realized by reference to the latter portions of the specification and attached drawings.

BRIEF DESCRIPTION OF THE DRAWINGS

A more complete understanding of the present invention and its advantages will be gained from a consideration of the following description of preferred embodiments, read in conjunction with the accompanying drawings provided herein. In the figures and description, numerals indicate various features of the invention, and like numerals referring to like features throughout both the drawings and the description.

DETAILED DESCRIPTION OF THE INVENTION

Figure 1:
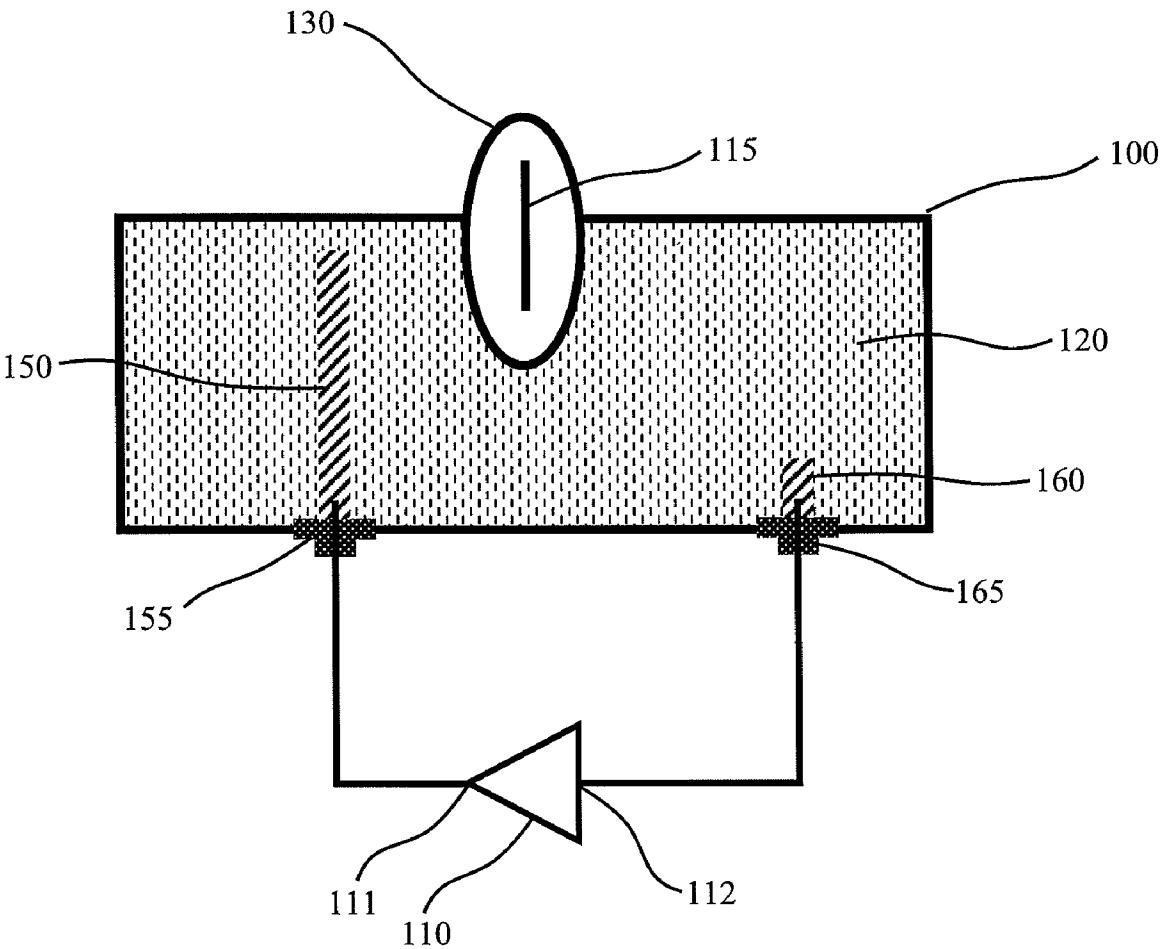
FIG. 1 is a simplified drawing of an embodiment of the present invention of an electrodeless plasma lamp with both an RF coupling element and a feedback coupling element.

According to the present invention, techniques for lighting are provided. In particular, the present invention provides a method and device using a plasma lighting device having a dielectric waveguide of a dielectric constant of less than two. More particularly, the present invention provides a method and apparatus having an electrodeless plasma lighting device using a resonator structure of a dielectric constant of less than two. Merely by way of example, the invention can be applied to a variety of applications such as stadiums, security, parking lots, military and defense, streets, large and small buildings, vehicle headlamps, aircraft landing, bridges, warehouses, UV water treatment, agriculture, architectural lighting, stage lighting, medical illumination, microscopes, projectors and displays, any combination of these, and the like.

The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the Claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object. Additionally, the terms "first" and "second" or other like descriptors do not necessarily imply an order, but should be interpreted using ordinary meaning.

FIG. 1 is a simplified drawing of an embodiment of the present invention. This diagram is merely an example, which should not unduly limit the scope of the claims herein. One of ordinary skill in the art would recognize other variations, modifications, and alternatives. The resonator/waveguide 100 is made from a dielectric material 120 with a dielectric constant of less than two. In a specific embodiment, the dielectric material comprises air, which has a dielectric constant of about 1. In various embodiments, resonator 100 comprises multiple dielectric materials, such as gas, fluid, and others. The surface of the dielectric material is covered with an electrically conductive layer or alternatively the resonator/waveguide can be made from a metallic housing and filled with the dielectric material. The gas filled vessel (bulb) 130 is inserted partially into the resonator/waveguide through a hole in the electrically conductive layer and the dielectric. The gas filled vessel is filled with an inert gas such as Argon or Xenon and a light emitter such as Mercury, Sodium, Dysprosium, Sulfur or a metal halide salt such as Indium Bromide, Scandium Bromide, Thallium Iodide, Holmium Bromide, Cesium Iodide or other similar materials (or it can simultaneously contain multiple light emitters). The RF coupling element 150 and feedback coupling element 160 are inserted into the resonator/waveguide through holes in the electrically conductive layer. The feedback coupling element is shorter than the RF coupling element. It is to be appreciated that the shorter length of the feedback coupling 160 compared to the RF coupling element 150 is specifically designed to provide appropriate resonant frequency.

An RF power amplifier 110 is connected between the feedback coupling element and the RF coupling element. The feedback coupling element 160 is connected to the input 112 of the RF power amplifier through an RF connector 165. The output of the RF amplifier 111 is connected to RF connector 155 which is connected to the RF coupling element 150. The resonator/waveguide in conjunction with the feedback coupling element, the amplifier, and the RF coupling element, form a resonant circuit and under the right oscillation condition the resonant circuit will oscillate and the RF amplifier will provide RF power to the resonator/waveguide. The resonator/waveguide couples the RF energy to the gas filled vessel resulting in ionization of the inert gas and vaporizing the light emitter(s) resulting in intense light emitted from the lamp 115.

Figure 2A:
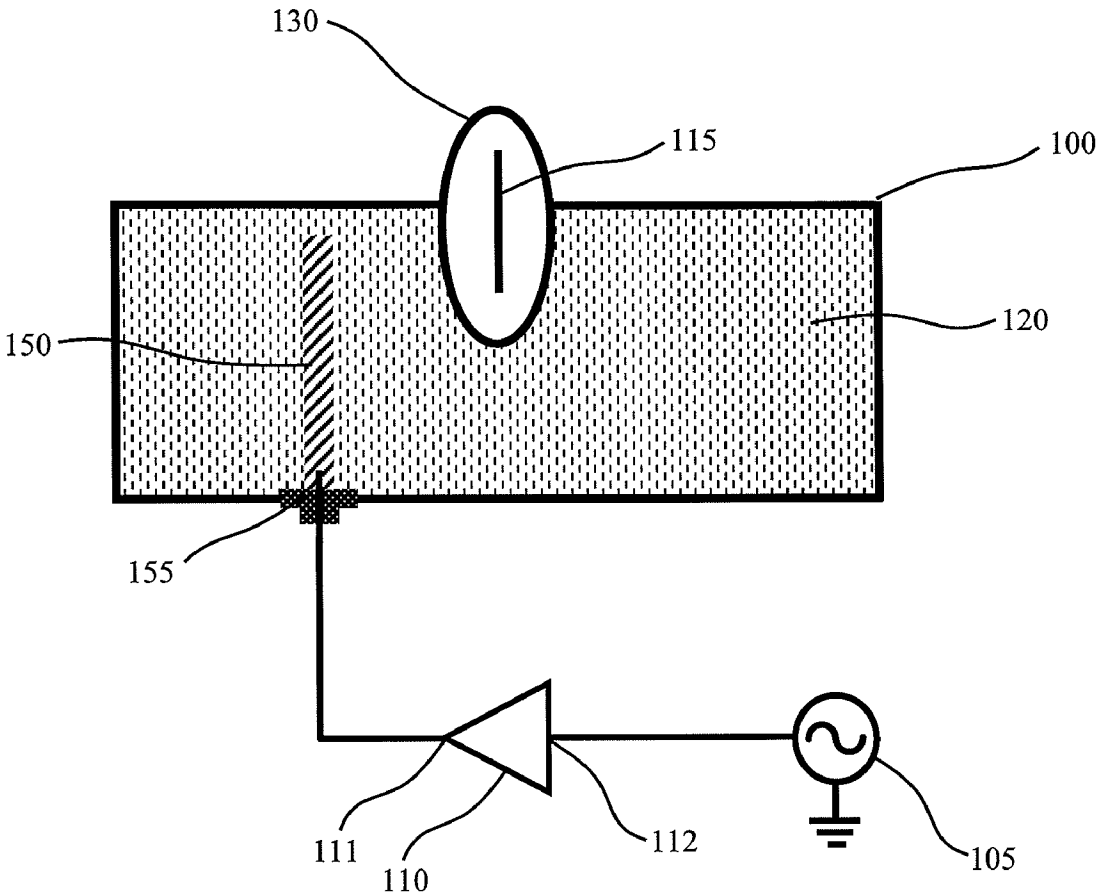
FIG. 2A is a simplified drawing of an embodiment of the present invention of an electrodeless plasma lamp with an RF coupling element and without a feedback coupling element.

FIG. 2A is a simplified drawing of another embodiment of the present invention. This diagram is merely an example, which should not unduly limit the scope of the claims herein. One of ordinary skill in the art would recognize other variations, modifications, and alternatives. This embodiment is similar to FIG. 1 except that the resonator/waveguide does not have a feedback coupling element. Instead an RF source 105 in conjunction with an RF amplifier 110 is used to provide RF power to the resonator/waveguide and to the lamp.

Figure 2B:
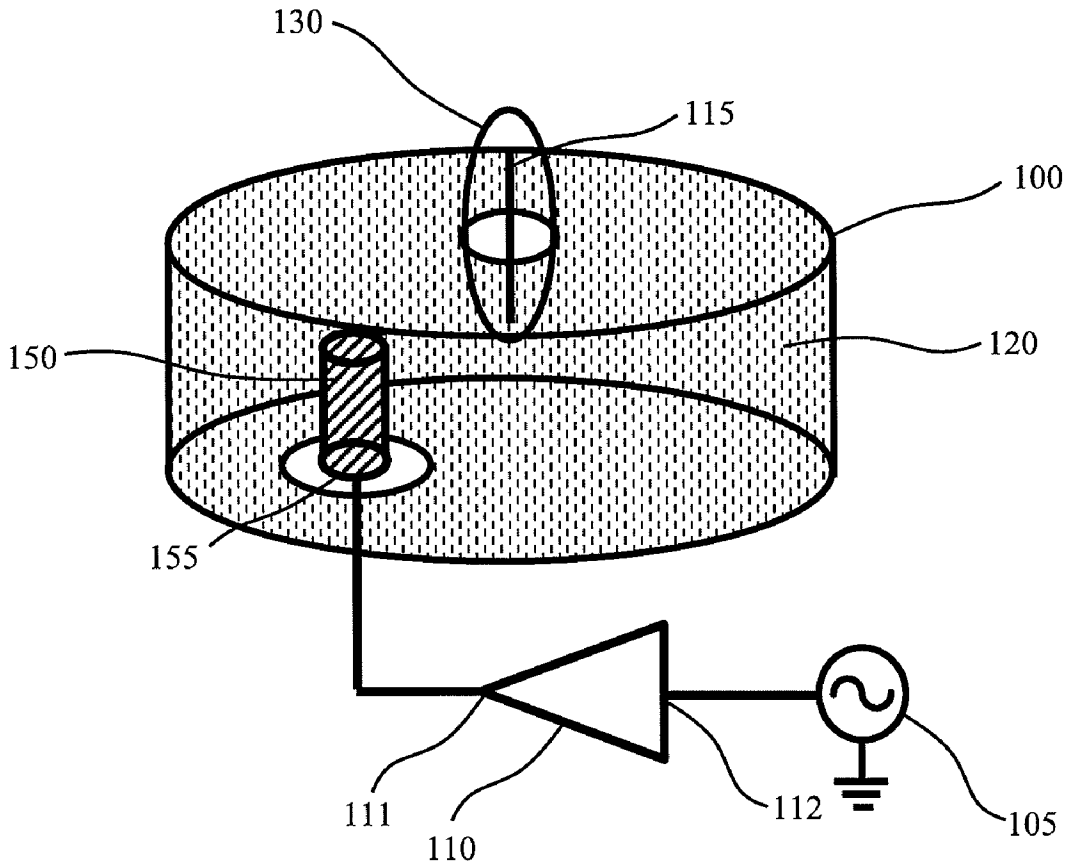
FIG. 2B is a simplified perspective view of the lamp in FIG. 2A illustrating the electrodeless plasma lamp with RF coupling element and without a feedback coupling element.

FIG. 2B is a simplified perspective view of the lamp shown in FIG. 2A illustrating the electrodeless plasma lamp with RF coupling element and without a feedback coupling element. A cylindrical lamp body is depicted, but rectangular or other shapes may be used. This diagram is merely an example, which should not unduly limit the scope of the claims herein. One of ordinary skill in the art would recognize other variations, modifications, and alternatives.

Figure 3:
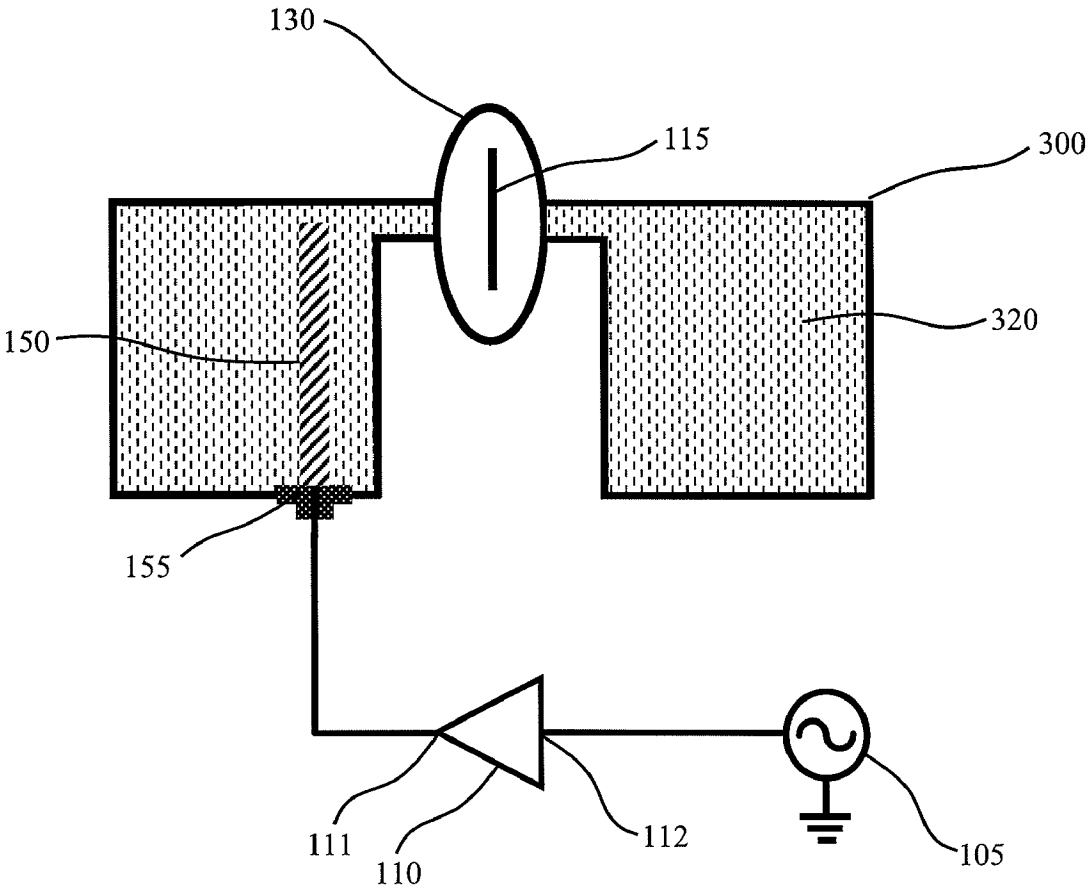
FIG. 3 is a simplified drawing of an embodiment of the present invention of an electrodeless plasma lamp. A folded resonator/waveguide structure is used to achieve a more compact structure.

FIG. 3 is a simplified drawing of another embodiment of the present invention of an electrodeless plasma lamp. This diagram is merely an example, which should not unduly limit the scope of the claims herein. One of ordinary skill in the art would recognize other variations, modifications, and alternatives. This embodiment is similar to FIG. 2A but a folded resonator/waveguide structure 300 is used instead to achieve a more compact structure using dielectric materials 320 with a dielectric constant of less than two.

Figure 4:
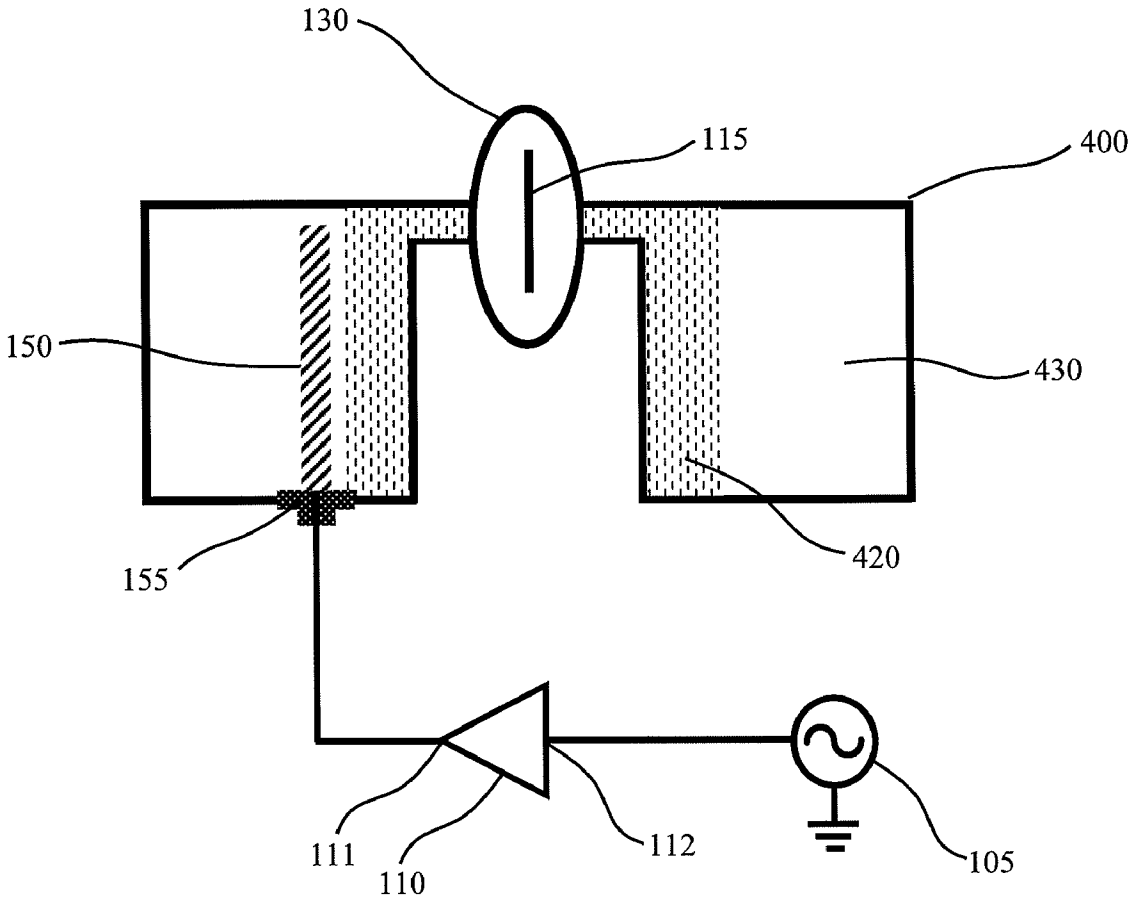
FIG. 4 is a simplified drawing of another embodiment of the present invention of an electrodeless plasma lamp. It is similar to FIG. 3 but the resonator/waveguide consists of multiple dielectric materials as well as possibly air to improve the performance of the electrodeless lamp.

FIG. 4 is a simplified drawing of another embodiment of the present invention of an electrodeless plasma lamp. This diagram is merely an example, which should not unduly limit the scope of the claims herein. One of ordinary skill in the art would recognize other variations, modifications, and alternatives. This embodiment is similar to FIG. 3 but the resonator/waveguide 400 consists of multiple dielectric materials 420 and 430 to improve the performance of the electrodeless lamp. Part of the resonator/waveguide can also be filled with air or vacuum to lower the overall RF loss of the resonator/waveguide and improve the performance of the lamp. Depending upon the embodiment, there can be other variations, modifications, and alternatives.

In a specific embodiment, the waveguide body can include variations. That is, the waveguide body can comprise the first material, which is one or more gases that are configured to decrease capacitance of the waveguide body. In a specific embodiment, either the first material or the second material comprises a volume of air. In other embodiments, the waveguide body can include the width that is less than five inches and the length that is less than five inches. Additionally, the width of the waveguide body is greater than the length of the waveguide body. Yet in other embodiments, the waveguide body further comprising a third material. In still further embodiments, at least one of the materials comprises a fluid, e.g., air or an inert gas. In other embodiments, the waveguide body can include other materials. That is, one of the materials comprises a conductive material. In a specific embodiment, the conductive material comprises a metal. Of course, there can be other variations, modifications, and alternatives.

In yet other embodiments, the waveguide body comprising a coupling element, which is coupled to an RF source and a reference potential. In a specific embodiment, the reference potential is a ground potential. Still further, the lamp can also include a capacitance characterizing a resonator formed by at least the power source and the waveguide body. Of course, there can be other variations, modifications, and alternatives.

In other embodiments, the bulb can have various configurations. The bulb can have a substantially cylindrical section (e.g., cross-section) or be contoured or combinations, and the like. In other embodiments, at least a portion of the bulb is spaced apart from the waveguide body by a gap. In a specific embodiment, the lamp has a bulb support, wherein the bulb is coupled to the waveguide body by the bulb support. Of course, there can be other variations, modifications, and alternatives.

Still further, the present lamp can be configured to resonate according to specific embodiments. The waveguide body resonates when the power is applied to the waveguide body at a frequency in the range of about 50 MHz to about 1 GHz. In a preferred embodiment, the bulb is positioned at a resonant field maximum and the width of the bulb is substantially smaller than one half of the wavelength of the power in free space or the like. In a specific embodiment, the lamp also has a feed (e.g., rf feed) in contact with the waveguide body. In a specific embodiment, the feed is coupled to the power source to provide power to the waveguide body. Again, there can be variations.

In further embodiments, the lamp includes the single axis of rotational symmetry of the bulb aligned with the central axis of the waveguide body. In a specific embodiment, the waveguide body is configured to provide an electric field maxima substantially parallel to the axis of rotational symmetry of the bulb. The waveguide body is configured to provide an electric field maxima substantially parallel to the central axis of the waveguide body. The bulb is elongated having a length that is parallel to the axis of rotational symmetry of the bulb, which has a parabolic contour. In other embodiments, at least one frequency that resonates within the waveguide body is a fundamental mode of resonance. The waveguide body can also have various shapes, e.g., a rectangular body, a right circular cylindrical body, combinations thereof. In other embodiments, the waveguide body has an outer surface comprising a metallic coating or other suitable material or combinations.

The waveguide body can also be configured with multiple rf feeds in other embodiments. That is, the lamp can include a first feed and a second feed both in contact with the waveguide body according to a specific embodiment. The first and second feeds are configured to provide the power to the waveguide body in a specific embodiment. At least one of the first and second feeds is configured to provide feedback from the waveguide body. Additionally, the plasma lamp can also include a probe configured to provide the power to the waveguide body according to a specific embodiment. The probe is aligned parallel to the axis of rotational symmetry of the bulb. In other embodiments, a probe is configured to provide the power to the waveguide body, the probe being aligned parallel to the central axis of the waveguide body. Again, there can be other variations, modifications, and alternatives.

While embodiments and advantages of this invention have been shown and described, it would be apparent to those skilled in the art that many more modifications are possible without departing from the inventive concepts herein. That is, one of ordinary skill in the art may further modify, combine, separate, or reorder, any of the elements described herein, as well as outside of the patent specification. The invention, therefore, is not to be restricted except in the spirit of the appended claims.

What is claimed is:

1. A plasma lamp comprising:

a waveguide body having a dielectric constant of less than two;

a power source coupled to the waveguide body to provide power to the waveguide body at least one frequency that resonates within the waveguide body; and a bulb containing a fill to form a plasma to cause emission of light when power is provided to the waveguide body, the bulb having a single axis of rotational symmetry and positioned proximate a central axis of the waveguide body, the waveguide body having a length substantially parallel to the central axis and a width transverse to the length.

2. The plasma lamp of claim 1 wherein the waveguide body comprises a first material, the first material including a gas configured to decrease capacitance of the waveguide body.

3. The plasma lamp of claim 1 wherein the waveguide body comprises air, wherein the width is less than five inches and the length is less than five inches.

4. The plasma lamp of claim 1 further comprising a capacitance characterizing a resonator formed by at least the power source and the waveguide body, wherein the width of the waveguide body is greater than the length of the waveguide body.

5. The plasma lamp of claim 1 wherein the waveguide body comprises at least three materials.

6. The plasma lamp of claim 5 wherein at least one of the materials comprises a fluid, wherein the fluid is air or an inert gas.

7. The plasma lamp of claim 5 wherein one of the materials comprises a conductive material, wherein the conductive material comprises a metal.

8. The plasma lamp of claim 1 wherein the waveguide body comprises a coupling element coupled to an RF source and a reference potential, wherein the reference potential is a ground potential.

9. The plasma lamp of claim 1, wherein the bulb has a substantially cylindrical section, wherein the bulb is contoured.

10. The plasma lamp of claim 1 wherein at least a portion of the bulb is spaced apart from the waveguide body by a gap, and wherein the plasma lamp further comprises a bulb support, wherein the bulb is coupled to the waveguide body by the bulb support.

11. The plasma lamp of claim 1 wherein the waveguide body resonates when the power is applied to the waveguide body at a frequency in the range of about 10 MHz to about 10 GHz; the bulb is positioned at a resonant field maximum; and the width of the bulb is substantially smaller than one half of the wavelength of the power in free space.

12. The plasma lamp of claim 1 further comprising a feed in contact with the waveguide body, wherein the feed is coupled to the power source to provide power to the waveguide body.

13. The plasma lamp of claim 1 wherein the single axis of rotational symmetry of the bulb is aligned with the central axis of the waveguide body.

14. The plasma lamp of claim 1 wherein the waveguide body is configured to provide an electric field maxima substantially parallel to the axis of rotational symmetry of the bulb.

15. The plasma lamp of claim 1 wherein the waveguide body is configured to provide an electric field maxima substantially parallel to the central axis of the waveguide body, wherein the at least one frequency that resonates within the waveguide body is a fundamental mode of resonance.

16. The plasma lamp of claim 1 wherein the bulb is elongated having a length that is parallel to the axis of rotational symmetry of the bulb.

17. The plasma lamp of claim 1 wherein the bulb has a parabolic contour, wherein the waveguide body has an outer surface comprising a metallic coating.

18. The plasma lamp of claim 1 wherein the waveguide body is a rectangular body or a right circular cylindrical body.

19. The plasma lamp of claim 1 further comprising a first feed and a second feed both in contact with the waveguide body, wherein at least one of the first and second feeds is configured to provide feedback from the waveguide body.

20. The plasma lamp of claim 1 further comprising a probe configured to provide the power to the waveguide body, the probe being aligned either parallel to the axis of rotational symmetry of the bulb or parallel to the central axis of the waveguide body.

21. The plasma lamp of claim 1 wherein the waveguide body comprises a solid dielectric material; the dielectric waveguide having a dielectric constant of less than two.

* * * * *